US010109391B2

(12) United States Patent
Richmond et al.

(10) Patent No.: US 10,109,391 B2
(45) Date of Patent: Oct. 23, 2018

(54) METALLIC/CARBON NANOTUBE COMPOSITE WIRE

(71) Applicant: Delphi Technologies, Inc., Troy, MI (US)

(72) Inventors: Zachary J. Richmond, Warren, OH (US); Evangelia Rubino, Warren, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 11 days.

(21) Appl. No.: 15/436,898

(22) Filed: Feb. 20, 2017

(65) Prior Publication Data

US 2018/0240569 A1 Aug. 23, 2018

(51) Int. Cl.

| | |
|---|---|
| ***H01B 7/00*** | (2006.01) |
| ***H01B 7/02*** | (2006.01) |
| ***H01B 1/02*** | (2006.01) |
| ***H01B 1/04*** | (2006.01) |
| ***H01R 4/18*** | (2006.01) |

(52) U.S. Cl.

CPC ..... *H01B 7/02* (2013.01); *H01B 1/02* (2013.01); *H01B 1/04* (2013.01); *H01R 4/183* (2013.01)

(58) Field of Classification Search

USPC ..... 174/126.1, 126.2, 36

See application file for complete search history.

(56) References Cited

U.S. PATENT DOCUMENTS

| | | | | |
|---|---|---|---|---|
| 7,226,531 | B2 | 6/2007 | Lo et al. | |
| 7,750,240 | B2 * | 7/2010 | Jiang | H01B 13/0162 174/102 R |
| 8,354,593 | B2 | 1/2013 | White et al. | |
| 8,445,788 | B1 * | 5/2013 | Tsotsis | H01B 1/24 174/126.1 |
| 8,808,792 | B2 * | 8/2014 | Starkovich | H01B 1/04 427/113 |
| 8,853,540 | B2 * | 10/2014 | Adriaenssens | C08K 3/04 174/126.2 |
| 9,111,658 | B2 * | 8/2015 | Shah | H01B 1/24 |
| 9,193,586 | B2 * | 11/2015 | Wei | B82Y 30/00 |
| 9,685,258 | B2 * | 6/2017 | Silverman | H01B 11/1008 |
| 2004/0020681 | A1 * | 2/2004 | Hjortstam | B82Y 30/00 174/102 SC |

(Continued)

FOREIGN PATENT DOCUMENTS

| | | | |
|---|---|---|---|
| CN | 202205480 | U | 4/2012 |
| JP | 2008277195 | A | 11/2008 |
| WO | 2011148977 | A1 | 12/2011 |

*Primary Examiner* — William H Mayo, III

(74) *Attorney, Agent, or Firm* — Robert J. Myers

(57) ABSTRACT

A multi-strand composite electrical conductor assembly includes a strand formed of carbon nanotubes and an elongated metallic strand having substantially the same length as the carbon nanotube strand. The assembly may further include a plurality of metallic strands that have substantially the same length as the carbon nanotube strand. The carbon nanotube strand may be located as a central strand and the plurality of metallic strands surround the carbon nanotube strand. The metallic strand may be formed of a material such as copper, silver, gold, or aluminum and may be plated with a material such as nickel, tin, copper, silver, and/or gold. Alternatively or additionally, the metallic strand may be clad with a material such as nickel, tin, copper, silver, and/or gold.

7 Claims, 2 Drawing Sheets

(56) References Cited

U.S. PATENT DOCUMENTS

2007/0284987 A1* 12/2007 Liu ..... B82Y 10/00
313/311
2008/0170982 A1* 7/2008 Zhang ..... B82Y 10/00
423/447.3
2008/0251270 A1* 10/2008 Lee ..... H01B 11/1817
174/105 R
2008/0283267 A1* 11/2008 Werth ..... H01B 1/04
174/68.1
2009/0173516 A1* 7/2009 Burke ..... B82Y 10/00
174/126.1
2010/0000754 A1* 1/2010 Mann ..... H01B 1/04
174/34
2010/0101828 A1* 4/2010 Duarte Pena ..... C09D 7/1291
174/120 C
2011/0005808 A1* 1/2011 White ..... H01B 1/026
174/126.2
2012/0045644 A1 2/2012 Wei et al.
2012/0090866 A1* 4/2012 Gundel ..... H01B 7/0861
174/34
2012/0125656 A1* 5/2012 Wei ..... B82Y 30/00
174/103
2013/0048337 A1* 2/2013 Hemond ..... D06M 13/50
174/113 C
2013/0233595 A1* 9/2013 Cooper ..... H01B 5/002
174/126.2
2014/0224524 A1* 8/2014 Gazda ..... H01B 1/04
174/126.2

* cited by examiner

METALLIC/CARBON NANOTUBE COMPOSITE WIRE

TECHNICAL FIELD OF THE INVENTION

The invention generally relates to electrical wires, and more particularly relates to a composite electrical wire formed of a carbon nanotube and metallic strands.

BACKGROUND OF THE INVENTION

Traditionally automotive electrical cables were made with copper wire conductors which may have a mass of 15 to 28 kilograms in a typical passenger vehicle. In order to reduce vehicle mass to meet vehicle emission requirements, automobile manufacturers have begun also using aluminum conductors. However, aluminum wire conductors have reduced break strength and reduced elongation strength compared to copper wire of the same size and so are not an optimal replacement for wires having a cross section of less than 0.75 $mm^2$ (approx. 0.5 mm diameter). Many of the wires in modern vehicles are transmitting digital signals rather than carrying electrical power through the vehicle. Often the wire diameter chosen for data signal circuits is driven by mechanical strength requirements of the wire rather than electrical characteristics of the wire and the circuits can effectively be made using small diameter wires.

Elongated composite conductors, or composite wires, that utilize a strength member, such as an aramid fiber strand, in conjunction with metal strands, have been used to improve the strength and reduce the weight of finished conductors. Other composites, such as those containing stainless steel strands, have been used to improve strength with little impact on weight. However, the inclusion of nonconductive members, such as Aramid fibers, or high resistance members, such as stainless steel, increase the overall electrical resistance of the composite wire. In addition, composite wires are not well suited for termination with crimped on terminals. During the crimping process, the nonconductive or highly resistant member may move to the outer portion of the wire, thereby causing increased resistance between the terminal and the wire. This increase is due to the high electrical resistance of aramid fibers and stainless steel strands.

Stranded carbon nanotubes (CNT) are lightweight electrical conductors that could provide adequate strength for small diameter wires. However, CNT strands do not currently provide sufficient conductivity for most automotive applications. In addition, CNT strands are not easily terminated by crimped on terminals. Further, CNT strands are not terminated without difficulty by soldered on terminals because they do not wet easily with solder.

Therefore, a lower mass alternative to copper wire conductors for small gauge wiring remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a multi-strand composite electrical conductor assembly is provided. The multi-strand composite electrical conductor assembly includes an elongated strand consisting essentially of carbon nanotubes having a length of at least 50 millimeters and an elongated metallic strand having substantially the same length as the carbon nanotube strand. The assembly may further include a plurality of metallic strands that have substantially the same length as the carbon nanotube strand. The carbon nanotube strand may be located as a central strand and the plurality of metallic strands surround the carbon nanotube strand. The assembly may consist of one carbon nanotube strand and six metallic strands. The metallic strand may be formed of a material such as copper, silver, gold, or aluminum. The metallic strand may be plated with a material such as nickel, tin, copper, silver, and/or gold. Alternatively or additionally, the metallic strand may be clad with a material such as nickel, tin, copper, silver, and/or gold. The assembly may further include an electrical terminal that is crimped or soldered to an end of the assembly. The assembly may also include an insulative sleeve that is formed of a dielectric polymer material that envelops both the metallic strand and the carbon nanotube strand.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Stranded carbon nanotube (CNT) conductors provide improved strength and reduced density as compared to stranded metallic conductors. Stranded CNT conductors have 160% higher tensile strength compared to a copper strand having the same diameter and 330% higher tensile strength compared to an aluminum strand having the same diameter. In addition, stranded CNT conductors have 16% of the density of the copper strand and 52% of the density of the aluminum strand. However, the stranded CNT conductor has 16.7 times higher resistance compared to the copper strand and 8.3 times higher resistance compared to the aluminum strand resulting in reduced electrical conductivity. To address the reduced electrical conductivity of stranded CNT conductors, a composite conductor, i.e. a composite wire, composed of one or more CNT strands with one or more metallic, metal plated, or metal cladded strands is provided. The CNT strands of the composite wire improve the strength and density of the resulting composite wire while the metal strands of the composite wire enhance the overall electrical conductivity. The high tensile strength of the CNT stands allow smaller diameter metallic conductors in a composite wire having equivalent overall tensile strength while the metallic strands provide adequate electrical conductivity, particularly in digital signal transmission applications. The low density of the CNT strands also provide a weight reduction compare to metallic strands. It has also been observed by the inventors that the inclusion of the conductive CNT strand(s) improves performance of crimped attachment of electrical terminals to the ends of the composite wire compared to composite wires made with aramid or stainless steel strands since the CNT strand 12 is both connective, unlike an aramid strand and has similar compression performance to a copper strand, unlike a stainless steel strand.

Figure 1:
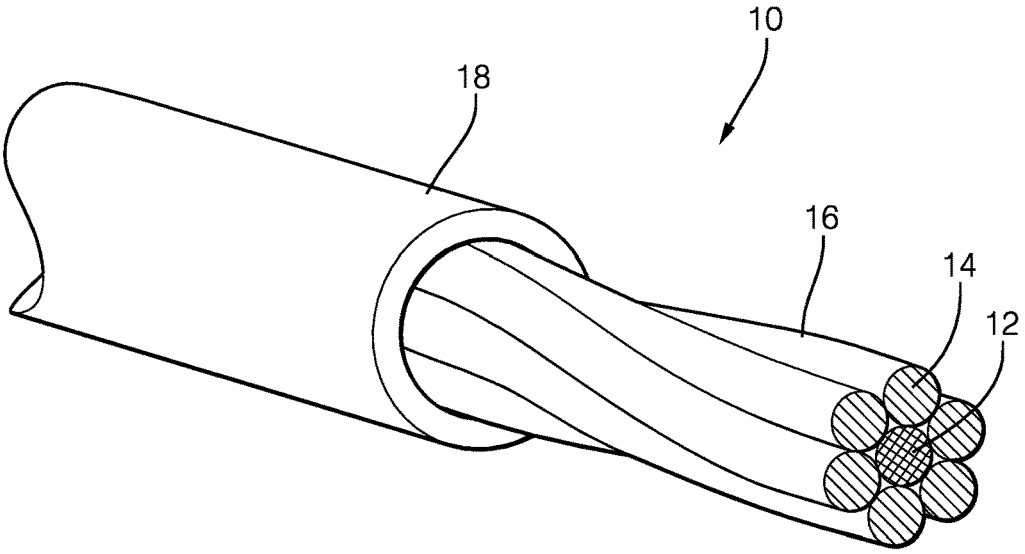
FIG. 1 is a perspective view of a multi-strand composite electrical conductor assembly in accordance with one embodiment.

FIG. 1 illustrates a non-limiting example of a multi-strand composite electrical conductor assembly, hereinafter referred to as the composite wire 10. The composite wire includes one elongated strand 12 that consists essentially of carbon nanotubes and has a length of at least 50 millimeters. In automotive applications, the composite wire may have a length of up to 7 meters. The carbon nanotubes (CNT) strand 12 is formed by spinning carbon nanotube fibers having a length ranging from about several microns to several millimeters into a strand or yarn having the desired length and diameter. The processes for forming CNT stands may use wet or dry spinning processes that are familiar to those skilled in the art. In the illustrated example, the CNT strand 12 is surrounded by six elongated metallic strands 14 formed of copper having substantially the same length as the carbon nanotube strand 12 and are twisted about the CNT strand 12. As used herein, "substantially the same length" means that the length of the copper strands 14 and the CNT strand 12 differ by 1% or less. Further, as used herein, the term "copper" means elemental copper or an alloy wherein copper is the primary constituent.

In alternative embodiments, the metallic strands 14 may be formed of aluminum, silver, or gold. As used herein, the terms "aluminum, silver, and gold" mean the elemental form of the named element or an alloy wherein the named element is the primary constituent. Additionally or alternatively, an outer surface of the metallic strand 14 may be plated or clad with another metallic material such as nickel, tin, copper, silver, and/or gold. The plating 16 or cladding 16 may be added to provide enhanced electrical conductivity of the metallic strand 14 or to provide corrosion resistance. As used herein, the terms "nickel and tin" mean the elemental form of the named element or an alloy wherein the named element is the primary constituent. The processes used to plate or clad the metallic wires 14 with other metals are well known to those skilled in the art.

The copper strands 14 and the CNT strand 12 are encased within an insulation jacket 18 formed of a dielectric material such as polyethylene (PE), polypropylene (PP), polyvinylchloride (PVC), polyamide (NYLON), or polytetrafluoroethylene (PFTE). The insulation jacket may preferably have a thickness between 0.1 and 0.4 millimeters. The insulation jacket 18 may be applied over the copper and CNT stands 12, 14 using extrusion processes well known to those skilled in the art.

Figure 2:
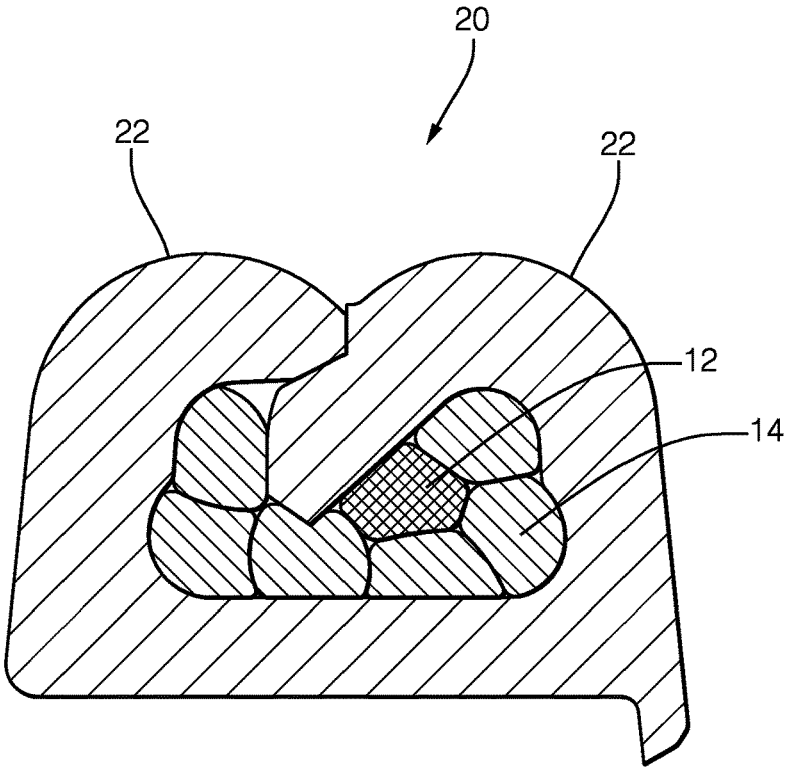
FIG. 2 is a cross section view of a terminal crimped to the multi-strand composite electrical conductor assembly of FIG. 1 in accordance with one embodiment.

As illustrated in FIG. 2, an end of the composite wire 10 is terminated by an electrical terminal 20 having a pair of crimping wings 22 that are folded over the composite wire 10 and are compressed to form a crimped connection between the composite wire 10 and the terminal 20. The inventors have discovered that a satisfactory connection between the composite wire 10 and the terminal 20 can be achieved using conventional crimping terminals and crimp forming techniques. Alternatively, the electrical terminal may be soldered to the end of the composite wire.

Figure 3:
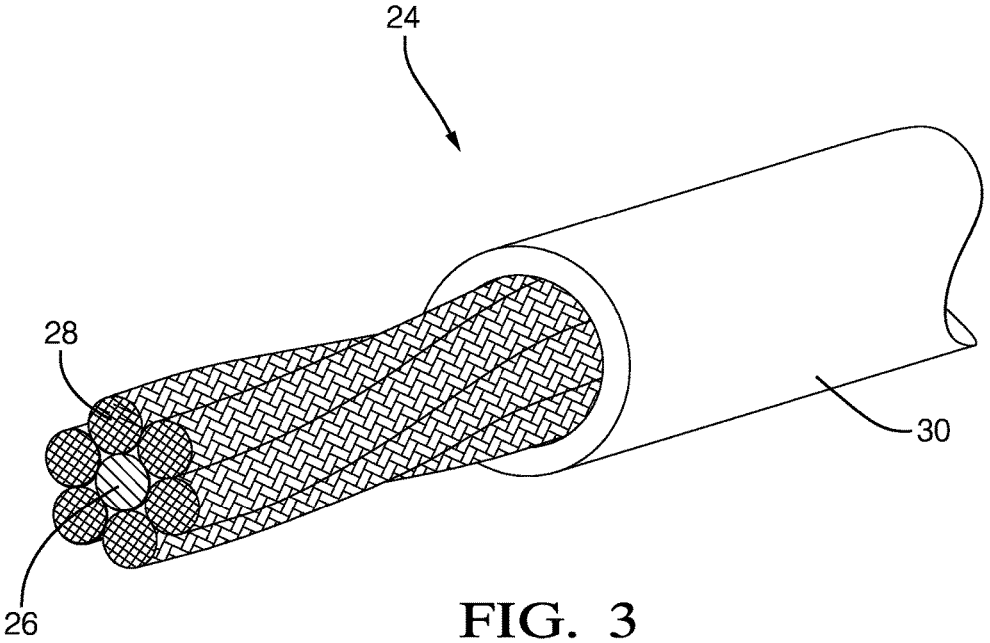
FIG. 3 is a perspective view of a multi-strand composite electrical conductor assembly in accordance with another embodiment.

FIG. 3 illustrates an alternate embodiment of the composite wire 24. As shown in FIG. 3, a single copper strand 26 is surrounded by six CNT stands 28. The copper strand 26 and the CNT strands 28 are encased within an insulation jacket 30 formed of a dielectric material such as polyethylene, polypropylene, polyvinylchloride, polyamide, or polytetrafluoroethylene.

Alternative embodiments of the composite wire may have more or fewer CNT strands and more or fewer metallic strands. The number and the diameter of each type of strand will be driven by design considerations of mechanical strength, electrical conductivity, and electrical current capacity. The length of the composite wire will be determined by the particular application of the composite wire.

Accordingly, a multi-strand composite electrical conductor assembly 10 or composite wire is provided. The composite wire 10 provides the benefit of a reduced diameter and weight compared to a metallic stranded wire while still providing adequate electrical conductivity for many applications, especially digital signal transmission.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A multi-strand composite electrical conductor assembly comprising:

an elongate strand consisting essentially of carbon nanotubes having a length of at least 50 millimeters; and an elongate aluminum strand plated or clad with a material selected from the list consisting of nickel, copper, silver, and gold having substantially the same length as the carbon nanotube strand.

2. The multi-strand composite electrical conductor assembly according to claim 1, further comprising a plurality of aluminum strands plated or clad with a material selected from the list consisting of nickel, copper, silver, and gold having substantially the same length as the carbon nanotube strand.

3. The multi-strand composite electrical conductor assembly according to claim 2, wherein the carbon nanotube strand is a central strand and wherein the plurality of aluminum strands surround the carbon nanotube strand.

4. The multi-strand composite electrical conductor assembly according to claim 3, wherein the multi-strand composite electrical conductor assembly consists of one carbon nanotube strand and six aluminum strands.

5. The multi-strand composite electrical conductor assembly according to claim 1, further comprising an electrical terminal crimped to an end of the multi-strand composite electrical conductor assembly.

6. The multi-strand composite electrical conductor assembly according to claim 1, further comprising an electrical terminal soldered to an end of the multi-strand composite electrical conductor assembly.

7. The multi-strand composite electrical conductor assembly according to claim 1, further comprising an insulative sleeve formed of a dielectric polymer material enveloping the aluminum strand and the carbon nanotube strand.

* * * * *